United States Patent [19]

Yokoyama et al.

[11] 4,437,682

[45] Mar. 20, 1984

[54] OUTRIGGER FOR USE IN WHEEL-TYPE VEHICLE

[75] Inventors: Masao Yokoyama; Masaharu Kon; Hiroshi Ota, all of Komatsu, Japan

[73] Assignee: Kabushiki Kaisha Komatsu Seisakusho, Tokyo, Japan

[21] Appl. No.: 377,449

[22] Filed: May 12, 1982

[30] Foreign Application Priority Data

Oct. 29, 1980 [JP] Japan ..... 55/153466

[51] Int. Cl.[3] ..... E02F 3/75

[52] U.S. Cl. ..... 280/764.1; 37/103; 188/5; 212/189

[58] Field of Search ..... 212/189; 414/687; 188/4 R, 5; 280/763.1, 764.1, 765.1; 37/103; 117/5

[56] References Cited

U.S. PATENT DOCUMENTS

| | | | |
|---|---|---|---|
| 2,929,517 | 3/1960 | Phillips | 280/764.1 |
| 3,398,972 | 8/1968 | Ekengard | 280/764.1 |
| 3,560,023 | 2/1971 | Norton et al. | 212/189 X |
| 3,807,586 | 4/1974 | Holopainen | 214/138 R |
| 4,082,197 | 4/1978 | Stedman | 212/189 X |
| 4,345,873 | 8/1982 | Wymore | 212/189 X |
| 4,401,408 | 8/1983 | Gibert | 280/764.1 X |

*Primary Examiner*—Joseph F. Peters, Jr.
*Assistant Examiner*—Michael Mar
*Attorney, Agent, or Firm*—Armstrong, Nikaido, Marmelstein & Kubovcik

[57] ABSTRACT

An outrigger for use in a wheel-type vehicle which can be mounted just behind a front wheel where available height for mounting is very limited. The outrigger comprises a support fixedly secured to an axle of the vehicle, a first and a second link both pivotally mounted to the support and being in parallel to each other, an earth contacting member pivotally connected to both first and second links, the earth contacting member being generally L-shaped when viewed from the bottom, and a hydraulic cylinder pivotally connected to the support and the earth contacting member.

3 Claims, 3 Drawing Figures

OUTRIGGER FOR USE IN WHEEL-TYPE VEHICLE

BACKGROUND OF THE INVENTION

This invention relates to an outrigger for use in a wheel-type earth moving or excavating vehicle.

A typical wheel-type earth moving vehicle equipped with a bucket operating mechanism is usually provided with an outrigger for the purpose of achieving prevention of the swing of the vehicle body due to the flexure of the tires, prevention of the vehicle body's slip and prevention of bursts of the tires due to the frictional forces excerted on them etc. when the vehicle is parked with its brakes applied and earth excavation, scooping and loading are carried out by using the bucket implement.

The above-mentioned outriggers for the vehicles of the kind specified above are usually located on the rear part of the vehicle or near the tires with the legs of the outriggers projected outwardly from the sides of the vehicle.

In the former case, if the outriggers were mounted on the front part of the vehicle, there might occur interference of the outrigger with the bucket implement and also the operational range of the bucket implement would be reduced, and therefore outriggers are mounted on the rear part of the vehicle. However, such an arrangement makes it impossible for the earth moving vehicles to be equipped with an earth moving blade means.

Whilst, in the latter case, because the legs of the outriggers are projected outwardly from the sides of the vehicle, when it is desired to drive the vehicle after releasing its brakes, it cannot be driven unless the legs of the outriggers are retracted and accommodated within the vehicle by moving them sideways. It would therefore be impossible to quickly move the vehicle, should an emergency arise, while the outriggers are in a ground engaging position.

SUMMARY OF THE INVENTION

It is therefore an object of the present invention to provide an outrigger for use in a wheel-type vehicle which overcomes the above noted problems of the prior art.

Another object of the present invention is to provide an outrigger for use in a wheel-type vehicle which can be mounted just behind a tire where available height for mounting is limited.

A further object of the present invention is to provide an outrigger for use in a wheel-type vehicle wherein an earth contacting member of the outrigger can be closely positioned to a tire.

A still further object of the present invention is to provide an outrigger for use in a wheel-type vehicle wherein an earth contacting member of the outrigger has a large area.

In accordance with an aspect of the present invention, there is provided an outrigger for use in a vehicle having wheels and an axle, comprising:

a support member fixedly secured to said axle; a first link pivotally mounted at one end thereof to said support member; a second link pivotally mounted at one end thereof to said support member, said first and second links being in parallel to each other; an earth contacting member having a first section extending at right angles with the normal travelling direction of the vehicle just behind one of the wheels, a second section extending at right angles with said first section towards front end of the vehicle along inside of said one of the wheels and a third section projecting upwards from said first section; the other end of said first link being pivotally connected to said earth contacting member at an upper end of said third section and the other end of said second link being pivotally connected to said earth contacting member; and hydraulic cylinder means pivotally connected at one end thereof to said support member and at the other end to said earth contacting member.

The above and other objects, features and advantages of the present invention will be readily apparent from the following description taken in conjunction with the accompanying drawings.

DESCRIPTION OF THE PREFERRED EMBODIMENT

Figure 1:
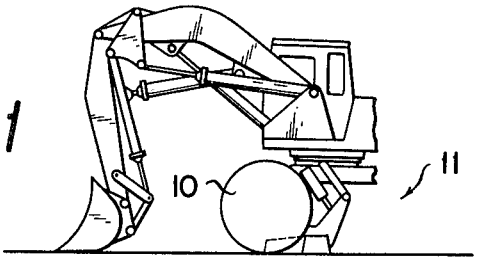
FIG. 1 is a fragmentary side elevational view of a wheel-type excavator equipped with outriggers according to the present invention.
Figure 2:
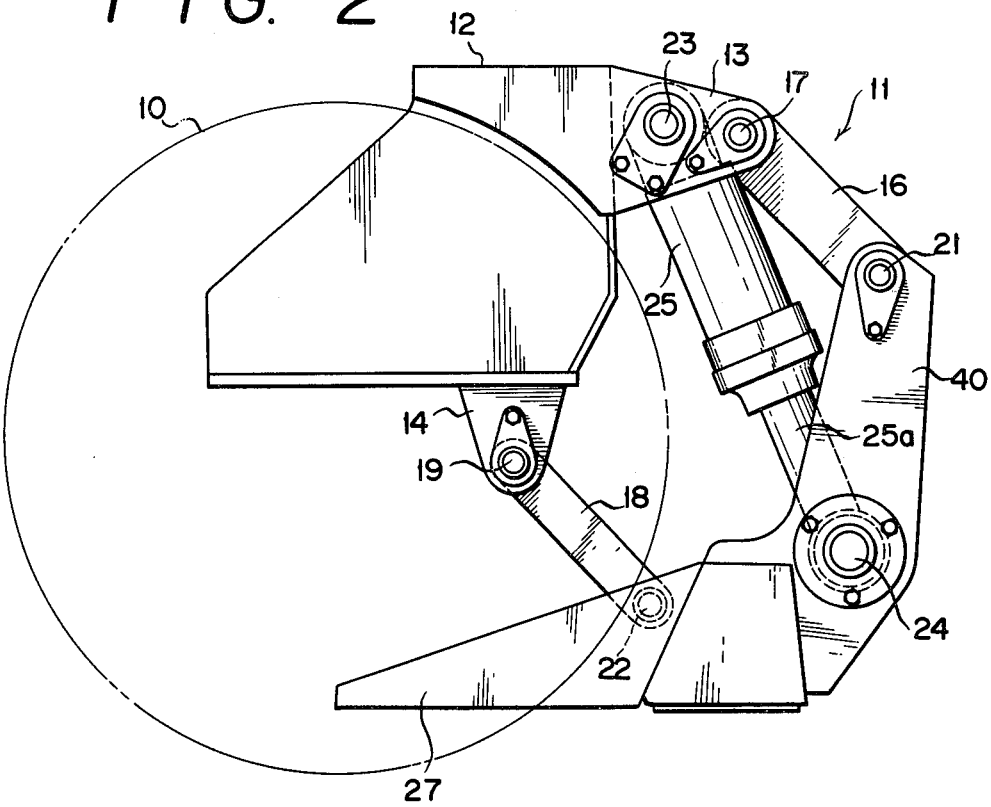
FIG. 2 is a side elevational view of an outrigger of the present invention wherein a tire is shown in an imaginary line.
Figure 3:
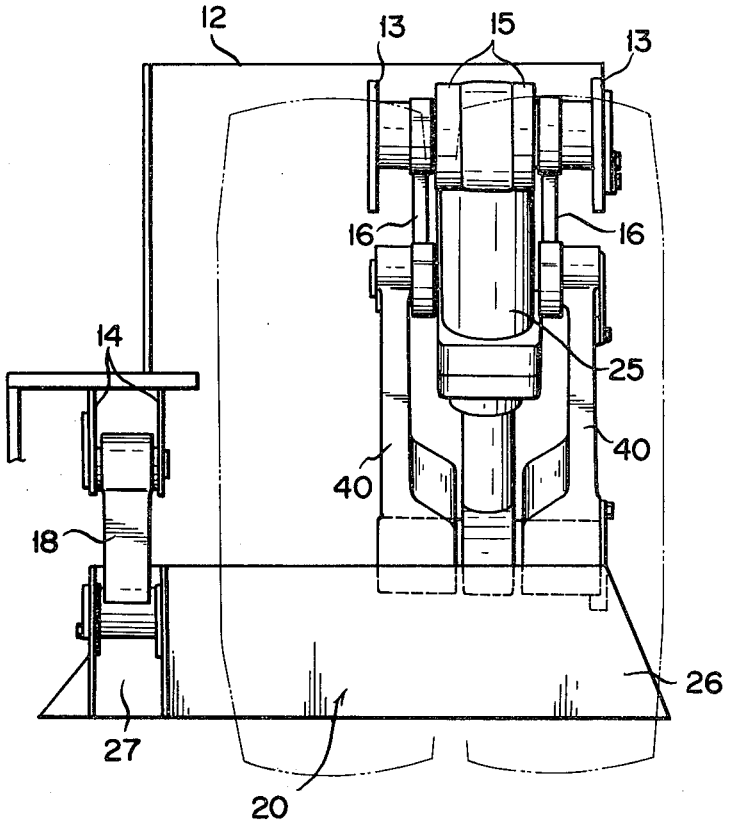
FIG. 3 is a front elevational view thereof.

The present invention will now be described below by way of example only with reference to the accompanying drawings.

In the drawings, reference numeral 10 denotes front wheels of a wheel-type earth moving or excavating vehicle and 11 outriggers. Since same outriggers 11 are mounted on both sides of the vehicle, following descriptions are made referring to only one side thereof. Each outrigger 11 comprises a support 12 mounted on an axle not shown.

The support 12 has fixedly secured thereon brackets 13, 14 and 15 and one end of each of a pair of links 16 is connected to the brackets 13 by means of a pin 17 and one end of another link 18 is connected to the brackets 14 by means of a pin 19. The other end of each of the pair of links 16 is connected to the upper part of respective uprights 40 of an earth contacting plate 20 by means of a pin 21. The other end of another link 18 is connected to the earth contacting plate 20 by means of a pin 22. Therefore, the earth contacting plate 20 is articulated at four points by means of the pins 17, 19, 21 and 22, the links 16 and 18 forming a part of a parallel four-point articulated linkage.

Connected to the brackets 15 of the support 12 by means of a pin 23 is a base end of a cylinder means 25. The cylinder means 25 has a rod **25*a* connected to the bent portion of the earth contacting plate 20 by means of a pin 24**.

The earth contacting plate 20 comprises a portion 26 extending in the direction of width of the tire 10 and a portion 27 extending forwardly along the inside of the tire 10 and therefore is generally L-shaped when viewed from the bottom.

In operation, the cylinder means 25 is actuated to move the earth contacting plate 20 downwards in parallel with the ground surface so that bottom surface thereof may be brought into contact with the ground surface.

Therefore, the links 16 and 18 effectively bear the loads imposed on the earth contacting plate 20.

When the rod 25*a* of the cylinder means 25 is retracted, the earth contacting plate 20 is pulled up through the links 16 and 18 forming a part of four-point linkage.

Since the present invention is constructed as mentioned in detail hereinabove, each outrigger can be mounted to the vehicle behind the respective tires 10 where available height is severely limited.

It is also possible to ground the earth contacting plates 20 near the tires and employ such an earth contacting plate having a large contacting area.

What is claimed is:

1. An outrigger for use in a vehicle having wheels and an axle, comprising:

a support member fixedly secured to said axle;

a first link pivotally mounted at one end thereof to said support member;

a second link pivotally mounted at one end thereof to said support member, said first and second links being in parallel to each other;

an earth contacting member having a first section extending at right angles with the normal travelling direction of the vehicle just behind one of the wheels, a second section extending at right angles with said first section towards the front end of the vehicle along the inside of said one of the wheels and a third section projecting upwards from said first section;

the other end of said first link being pivotally connected to said earth contacting member at an upper end of said third section and the other end of said second link being pivotally connected to said earth contacing member; and hydraulic cylinder means pivotally connected at one end thereof to said support member and at the other end to said earth contactng member.

2. An outrigger as recited in claim 1 wherein said support member, said first and second links and said earth contacting member form in combination a parallelogram linkage.

3. An outrigger as recited in claim 1 or 2 wherein said one of the wheels is a front wheel.

* * * * *